US009161674B2

(12) United States Patent
Garnett

(10) Patent No.: US 9,161,674 B2
(45) Date of Patent: Oct. 20, 2015

(54) SILVERWARE BASKET WITH FEATURES FOR ASSISTING REMOVAL OF THE SILVERWARE BASKET FROM A DISHWASHER APPLIANCE

(75) Inventor: William Nathan Garnett, Ekron, KY (US)

(73) Assignee: General Electric Company, Schenectady, NY (US)

( * ) Notice: Subject to any disclaimer, the term of this patent is extended or adjusted under 35 U.S.C. 154(b) by 801 days.

(21) Appl. No.: 13/442,999

(22) Filed: Apr. 10, 2012

(65) Prior Publication Data

US 2013/0263896 A1 Oct. 10, 2013

(51) Int. Cl.
*A47L 15/42* (2006.01)
*A47L 15/50* (2006.01)

(52) U.S. Cl.
CPC ..... *A47L 15/4257* (2013.01); *A47L 15/502* (2013.01)

(58) Field of Classification Search
USPC ..... 134/56 D, 57 D, 58 D, 85, 92, 135, 137, 134/164; 312/228.1; D32/3; 220/494, 607
See application file for complete search history.

(56) References Cited

U.S. PATENT DOCUMENTS

| | | | | |
|---|---|---|---|---|
| 7,073,682 | B2 * | 7/2006 | Raches et al. | 220/488 |
| 2005/0045215 | A1 | 3/2005 | Raches et al. | |
| 2006/0237051 | A1 | 10/2006 | Bengston et al. | |
| 2006/0237053 | A1 | 10/2006 | Bengston et al. | |

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

A dishwasher appliance is provided with a silverware basket. The silverware basket includes a ramp that is configured for urging the silverware basket away from a door of the appliance when the silverware basket is being detached from the door. The ramp can, e.g., assist a user in removing the silverware basket.

15 Claims, 6 Drawing Sheets

FIG. –1–

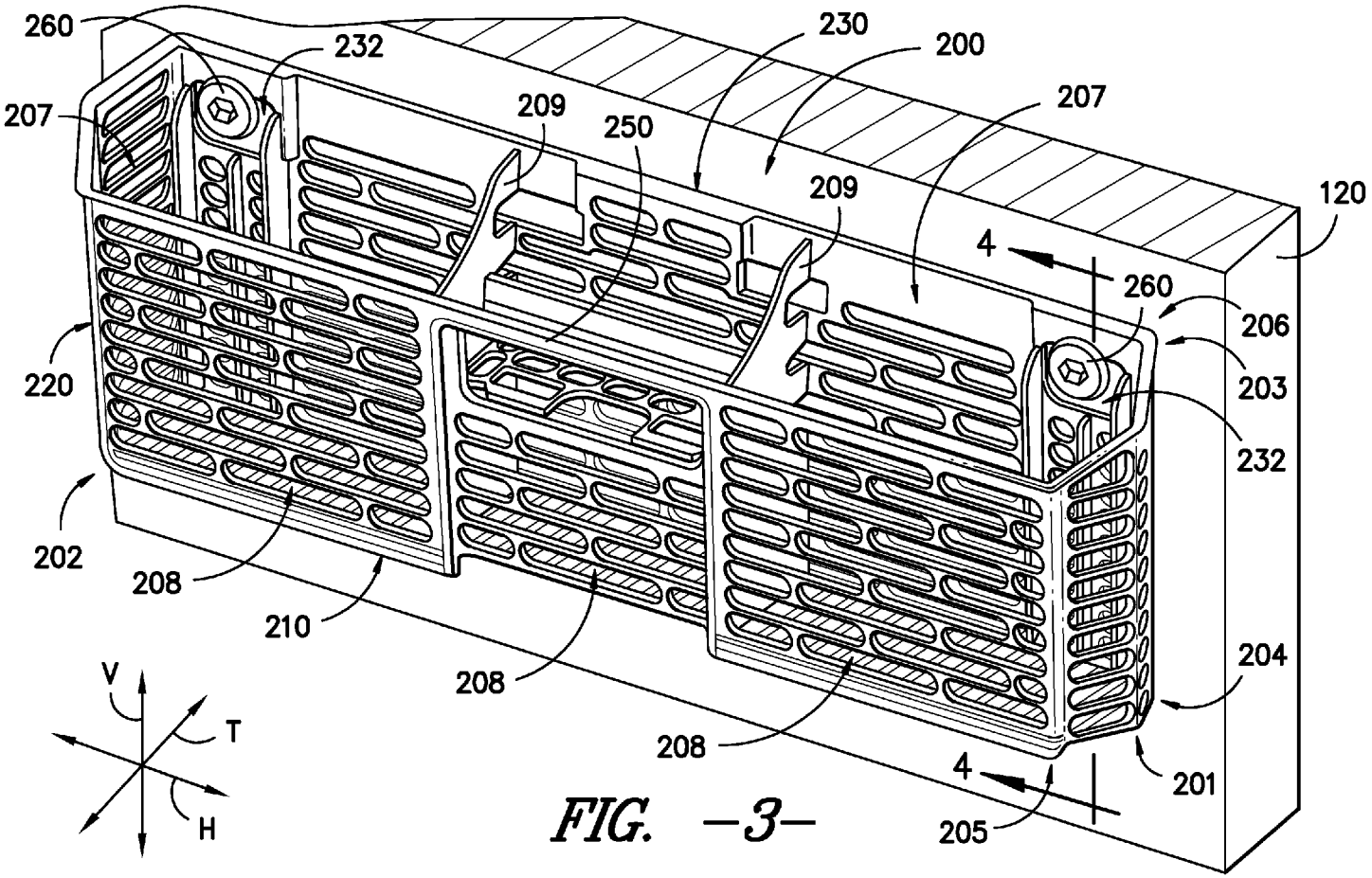
FIG. —3—

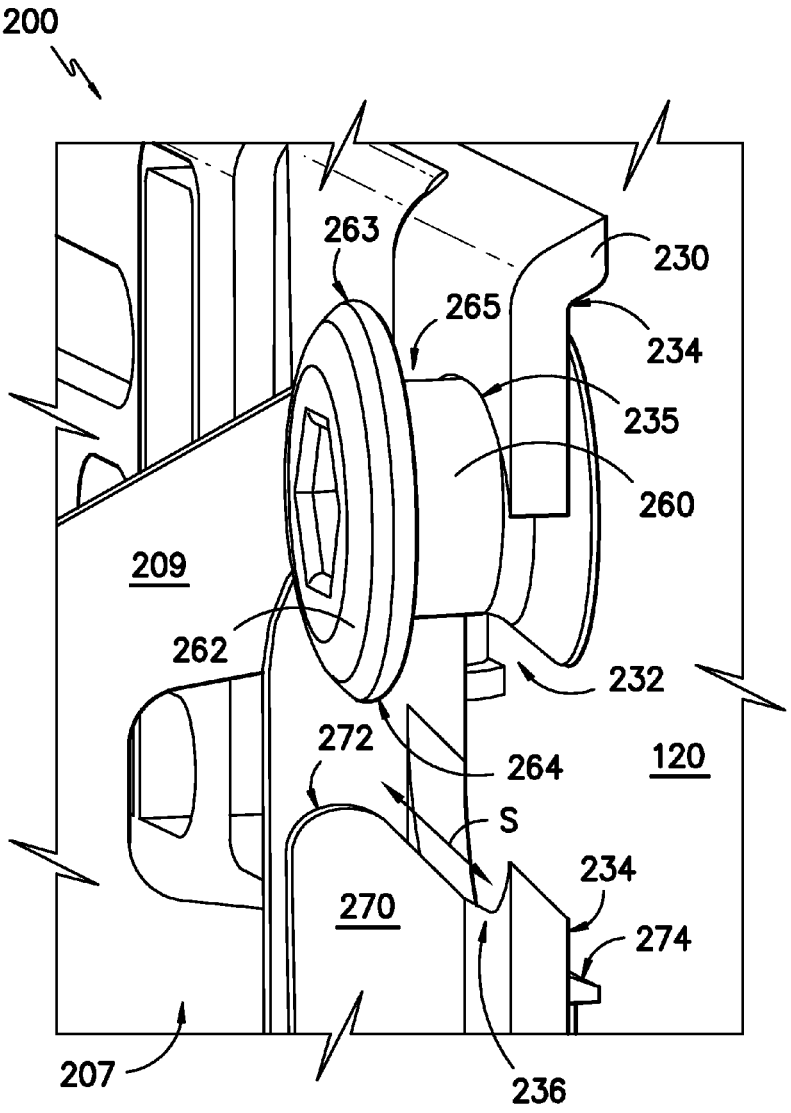
FIG. —4—
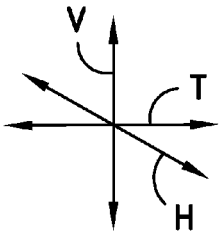

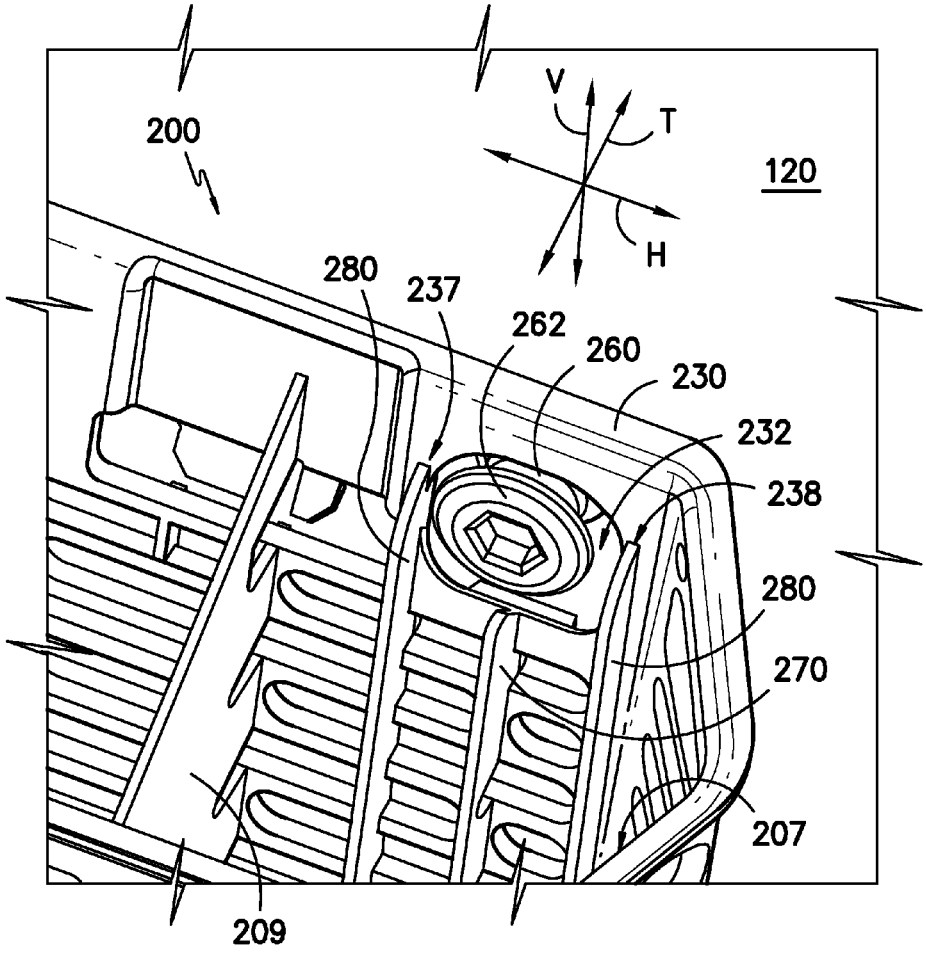
FIG. –5–

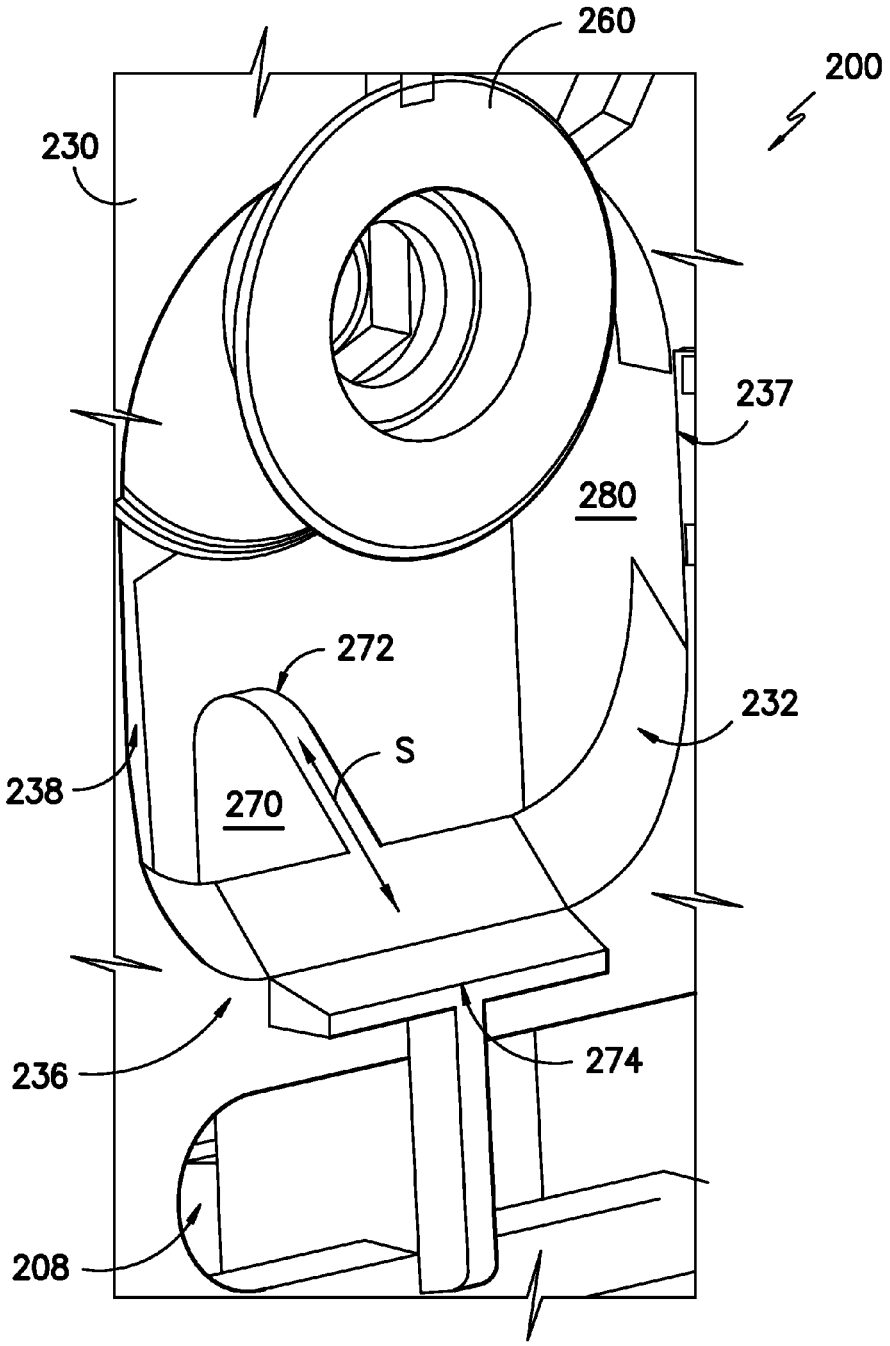
FIG. –6–

SILVERWARE BASKET WITH FEATURES FOR ASSISTING REMOVAL OF THE SILVERWARE BASKET FROM A DISHWASHER APPLIANCE

FIELD OF THE INVENTION

The present subject matter relates generally to silverware baskets for dishwasher appliances.

BACKGROUND OF THE INVENTION

Dishwasher appliances generally include a cabinet that defines a wash chamber. A rack assembly can be slidably received within the wash chamber and configured for receipt of articles (e.g., plates, cups, and/or bowls) for washing. A spray arm assembly configured for applying wash fluid to the articles in the rack assembly can also be mounted within the wash chamber.

Certain dishwasher appliances also include a silverware basket configured for receipt of articles (e.g., forks, knives, spoons, and/or other utensils) for washing. The silverware basket can be mounted within the wash chamber in various configurations. For example, the silverware basket can be mounted within the rack assembly, on a front of the rack assembly, and/or on a door of the appliance.

To mount the silverware basket to the door, certain dishwasher appliances include supports attached to a door of the appliance. The supports are configured for holding the silverware basket such that the silverware basket hangs on the door. The supports can be received by openings defined by the silverware basket. For example, a back wall of the silverware basket can define the openings such that the supports may be selectively inserted into the openings in order to mount the silverware basket to the door. Similar supports can be used to mount the silverware basket to the front of the rack assembly or at any other suitable location within the dishwasher appliance.

A user can pull upwardly on a handle of the silverware basket, and the supports can disengage from the silverware basket. However, during removal of the supports from the openings, certain silverware baskets catch or hang up on the supports. For example, the supports can be substantially circular supports with a circular flange. During removal of the circular supports from the openings, portions of the back wall can become lodged under the circular flange of the circular supports. When the back wall catches the circular flange, removal of the silverware basket can be impeded or obstructed.

Accordingly, a silverware basket with features for assisting removal of the silverware basket would be useful. In particular, a silverware basket with features for hindering a back wall of the silverware basket from snagging on a support would be useful.

BRIEF DESCRIPTION OF THE INVENTION

Aspects and advantages of the invention will be set forth in part in the following description, or may be apparent from the description, or may be learned through practice of the invention.

In a first embodiment, a dishwasher appliance is provided. The dishwasher appliance includes a cabinet having a wash chamber for the receipt of articles for cleaning. The cabinet defines an opening for access to the wash chamber. A door is rotatably mounted to the cabinet adjacent the opening of the cabinet. The door is configured for permitting selective access to the wash chamber of the cabinet through the opening. A support is mounted to the door. The support has a flange mounted to a distal end of the support. A rack assembly is slidably mounted within the wash chamber and configured for the receipt of the articles. A silverware basket is removably mounted to the door with the support. The silverware basket extends between a first side and a second side along a horizontal direction. The silverware basket further extends between a top and a bottom along a vertical direction. The silverware basket also extends between a front and a back along a transverse direction. The transverse direction is perpendicular to the horizontal and vertical directions. The silverware basket includes a bottom wall and a front wall extending from the bottom wall along the vertical direction. A back wall extends from the bottom wall along the vertical direction and is spaced apart from the front wall along the transverse direction. The bottom wall, the back wall, and the front wall define a cavity for receipt of articles for cleaning. The back wall defines an opening configured for receipt of the support. A portion of the back wall is received between the door and the flange of the support in order to mount the silverware basket to the door. A ramp is fixed to the back wall adjacent the opening. The ramp has a low point and a high point spaced apart from the low point along the transverse direction with the high point disposed above the low point along the vertical direction. The ramp is configured for urging the silverware basket away from the door during removal of the silverware basket. The dishwasher appliance also includes a spray arm assembly for applying a fluid to the articles in the rack assembly and the silverware basket.

In a second embodiment, a silverware basket for a dishwasher appliance is provided. The silverware basket extends between a first side and a second side along a horizontal direction. The silverware basket further extends between a top and a bottom along a vertical direction. The silverware basket also extends between a front and a back along a transverse direction. The transverse direction is perpendicular to the horizontal and vertical directions. The silverware basket includes a bottom wall, a front wall extending from the bottom wall along the vertical direction, and a back wall extending from the bottom wall along the vertical direction and spaced apart from the front wall along the transverse direction. The bottom wall, the back wall, and the front wall define a cavity for receipt of articles for cleaning. The back wall defines an opening configured for receipt of a support in order to mount the silverware basket to a door of the dishwasher appliance. A ramp is fixed to the back wall adjacent the opening. The ramp has a low point and a high point spaced apart from the low point along transverse direction with the high point being disposed above the low point along the vertical direction. The ramp is configured for cooperating with the support during dismounting of the silverware basket from the door of the dishwasher appliance in order to urge the silverware basket away from the door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 illustrates a perspective view of the silverware basket and a portion of the door of FIG. 2 with a support securing the silverware basket to the door.

FIG. 4 provides a partial, cross-sectional view of the door and silverware basket of FIG. 3 taken along the 4-4 axis with the support extending from the door through an opening defined in a back wall of the silverware basket in order to support the silverware basket and also illustrates a ramp of the silverware basket.

FIG. 5 provides a partial, perspective view of the door and silverware basket of FIG. 3 with the support extending through the opening of the silverware basket and, in particular, illustrates a rail of the silverware basket.

FIG. 6 illustrates a partial, rear view of the silverware basket of FIG. 3 with the door removed to show the support extending through the opening of the silverware basket and the ramp of the silverware basket.

DETAILED DESCRIPTION OF THE INVENTION

Figure 1:
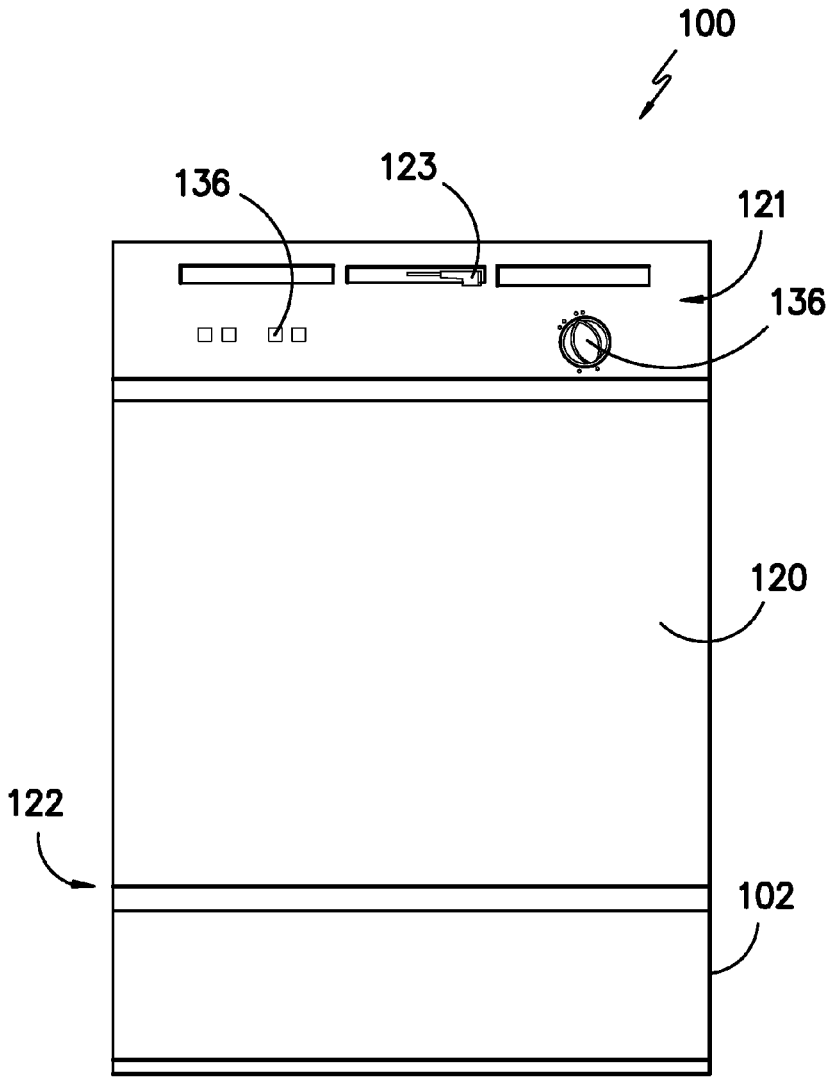
FIG. 1 provides a front view of a dishwasher appliance according to an exemplary embodiment of the present subject matter.

A dishwasher appliance is provided with a silverware basket. The silverware basket includes a ramp that is configured for urging the silverware basket away from a door of the appliance when the silverware basket is being detached from the door. The ramp can, e.g., assist a user in removing the silverware basket. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
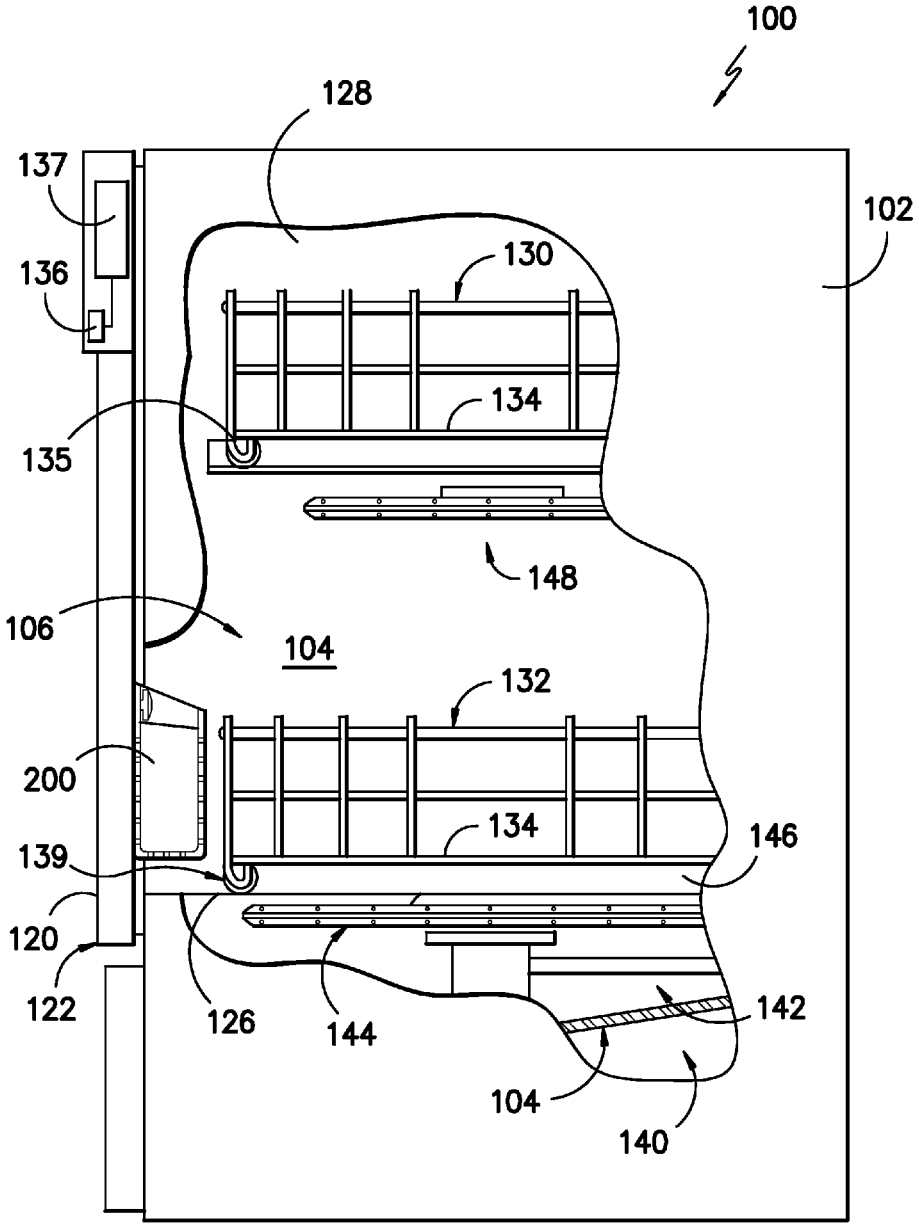
FIG. 2 provides a side view of the dishwasher appliance of FIG. 1 with a portion of the cabinet removed to reveal an interior of the dishwasher appliance and, particularly, to reveal an exemplary embodiment of a silverware basket mounted to a door of the appliance.

FIGS. 1 and 2 depict an exemplary domestic dishwasher 100 that may be configured in accordance with aspects of the present disclosure. The dishwasher 100 includes a cabinet 102 having a tub 104 therein that defines a wash chamber 106. The tub 104 includes a door 120 hinged at its bottom 122 for movement between a normally closed configuration (shown in FIGS. 1 and 2), wherein the wash chamber 106 is sealed shut (e.g., for washing operation), and an open configuration (e.g., for loading and unloading of articles from the dishwasher). A latch 123 is used to lock and unlock the door 120 for access to the chamber 106.

Guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106.

A silverware basket 200 is removably mounted to door 120. However, silverware basket 200 may also be selectively attached to other portions of dishwasher 100, e.g., lower rack 132. Silverware rack 200 is configured for receipt of silverware, utensils, and the like, that are too small to be accommodated by the upper and lower racks 130, 132. Silverware basket 200 may be constructed of any suitable material, e.g., metal or plastic, and is discussed in greater detail below.

The dishwasher 100 further includes a lower spray-arm assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly (not shown) for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively and silverware basket 200. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher and that the embodiment depicted in FIGS. 1 and 2 is for illustrative purposes only. For example, the present subject matter may be used in dishwasher appliances having other rack configurations.

FIG. 3 illustrates a perspective view of silverware basket 200 mounted to door 120. Silverware basket 200 extends between a first side 201 and a second side 202 along a horizontal direction H. Silverware basket 200 further extends between a top 203 and a bottom 204 along a vertical direction V. Silverware basket 200 also extends between a front 205 and a back 206 along a transverse direction T. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Silverware basket 200 includes a bottom wall 210. A front wall 220 extends from bottom wall 210 along the vertical direction V. Similarly, a back wall 230 extends from bottom wall 210 along the vertical direction V. Back wall 230 and front wall 220 are spaced apart along the transverse direction T. Dividers 209 extend between front wall 220 and back wall 230 along the transverse direction T. Bottom wall 210, front wall 220, back wall 230, and dividers 209 define a plurality of cavities 207 configured for receipt of articles (e.g., forks, knives, spoons, and/or other utensils).

Bottom wall 210, front wall 220, and back wall 230 also define a plurality of holes 208. Plurality of holes 208 permit wash fluid to flow into and out of cavity 207, e.g., during operation of dishwasher appliance 100. Plurality of holes 208 also permit a flow of air through cavity 207, e.g., to assist in drying articles therein.

As discussed in greater detail below, a pair of supports 260 is mounted to door 120. Supports 260 are configured for selectively attaching silverware basket 200 to door 120. For example, as shown in FIG. 3, each of the supports 260 may be disposed within a particular one of a pair of openings 232 defined by back wall 230 of silverware basket 200. Openings 232 are sized to permit supports to pass through openings 232 in order to selectively mount silverware basket 200 to door 120.

A handle 250 is mounted to silverware basket 200. A user can lift on handle 250 to remove silverware basket 200 from door 120 or rack assembly 130 (FIG. 2). For example, with silverware basket 200 mounted to door 120 as shown in FIG. 3, a user can lift on handle 250 and urge silverware basket 200 upwardly along the vertical direction V in order to remove silverware basket 200 from door 120 as discussed in more detail below.

FIG. 4 provides a partial, cross-sectional view of door 120 and silverware basket 200 taken along the 4-4 axis (FIG. 3). Support 260 extends from door 120 through opening 232 in order to hold up silverware basket 200. Opening 232 extends between a top end 235 and a bottom end 236 along the vertical direction V. Support 260 engages back wall 230 of basket 200 at top end 235 of opening 232 to support silverware basket 200.

Support 260 has a flange 262 that is spaced apart from door 120 along the transverse direction T at a distal end 265 of support 260. Flange 262 extends between a top 263 and a bottom 264 and is substantially circular. However, in alternative embodiments, flange 262 may have any suitable shape, e.g., oval or rectangular. A portion of back wall 230 is disposed between top 263 of flange 262 and door 120 in order to mount silverware basket 200 to door 120.

As an example, with silverware basket 200 removed from door 120, a user may adjust silverware basket 200 until support 260 is disposed within opening 232. The user may then move silverware basket 200 along the vertical direction V or allow gravity to urge silverware basket 200 along the vertical direction V until a portion of back wall 230 is disposed between top 263 of flange 262 and door 120 at top end 235 of opening 232 as shown in FIG. 4. In the configuration shown in FIG. 4, silverware basket 200 is prevented from moving downwardly in the vertical direction V by support 260. Similarly, silverware basket 200 is prevented from moving along the transverse direction T by flange 262 and door 120.

A ramp 270 is mounted to back wall 230 of silverware basket 200 adjacent bottom end 236 of opening 232. Ramp 270 has high point 272 and a low point 274. High point 272 is spaced apart from low point 274 along the vertical direction V and the transverse direction T. Thus, ramp 270 extends longitudinally between high point 272 and low point 274 such that ramp defines a slope S along the vertical direction V and transverse direction T. Slope S may be any suitable ratio between a change in vertical direction V and a change in transverse direction T, e.g., about one to one. In FIG. 4, ramp 270 is substantially linear. However, ramp 270 may have any suitable shape, e.g., curved or arcuate.

High point 272 is spaced apart from back wall 230 along the transverse direction such that high point 272 is disposed within one of the plurality of cavities 207. Low point 274 is also spaced apart from back wall 230 along the transverse direction such that low point 274 is disposed on an exterior 234 of back wall 230. However, in alternative embodiments, low point 274 may be disposed at any suitable location, e.g., adjacent back wall 230 and/or within one of the plurality of cavities 207. In additional alternative embodiments, ramp 270 may be a portion of one of dividers 209 such that ramp 270 is formed from one of dividers 209. Also, ramp 270 may extend through opening 232 such that bottom end 236 of opening 232 is angled at slope S.

As discussed above, to dismount silverware basket 200 from door 120, a user can move silverware basket 200 upwardly along the vertical direction, e.g., using handle 250 (FIG. 3). As may be seen in FIG. 4, when silverware basket 200 moves upwardly along the vertical direction V, back wall 230 is no longer disposed between top 263 of flange 262 and door 120. As silverware basket 200 moves along vertical direction V, bottom 264 of flange 262 impacts ramp 270 of silverware basket 200.

When bottom 264 of flange 262 impacts ramp 270 and the user continues to lift silverware basket 200 along vertical direction V, bottom 264 of flange 262 slides along ramp 270 from about high point 272 to about low point 274. Thus, bottom 264 of flange 262 is directed by ramp 270 along slope S out of opening 232. In addition, as bottom 264 of flange 262 slides along ramp 270, silverware basket 200 is urged along the transverse direction T away from door 120.

Thus, the interaction of bottom 264 of flange 262 and ramp 270, urges silverware basket 200 away from door 120 during dismounting of silverware basket 200 from support 260. Such interaction can assist the user by preventing bottom 264 of flange 262 from snagging or catching bottom wall 230 during removal of silverware basket 200.

As will be understood by those skilled in the art, without ramp 270, a portion of back wall 230 adjacent ramp 270 could become disposed between bottom 264 of flange 262 and door 120 as the user lifted silverware basket 200 along vertical direction V, thus, preventing movement of the silverware basket 200 along the transverse direction T. Such a configuration can be inconvenient and irritating because removal of support 260 from opening 232 is impeded or hindered by bottom 264 of flange 262. Ramp 270 facilitates removal of support 260 from opening 232 by hindering bottom 264 of flange 262 from becoming disposed between back wall 230 and door 120.

FIG. 5 provides a partial, top view of door 120 and silverware basket 200. As may be seen in FIG. 5, rails 280 of silverware basket 200 extend from back wall 230 into one of the plurality of cavities 207 along the transverse direction T. Rails 280 are disposed adjacent opening 232. Opening 232 extends between a first side 237 and a second side 238 along the horizontal direction H. Rails 280 are disposed on both first and second sides 237, 238 of opening 232. Rails 280 extend longitudinally along the vertical direction V adjacent first and second sides 237, 238 of opening 232. Rails 280 are configured for directing support 260 during removal of silverware basket 200 from door 120.

As discussed above, silverware basket 200 moves upwardly along the vertical direction V during removal. Rails 280 are configured for hindering flange 262 from snagging on back wall 230. As will be understood by those skilled in the art, without rails 280, a portion of back wall 230 adjacent rails 280 could become disposed between flange 262 and door 120 as the user lifted silverware basket 200 along vertical direction V, thus, preventing movement of the silverware basket 200 along the transverse direction T. Rails 280 hinder movement of silverware basket 200 along the horizontal direction H during removal of silverware basket 200 from door 120 and, thus, hinder a portion of back wall 230 adjacent rails 280 from becoming disposed between flange 262 and door 120.

FIG. 6 illustrates a partial, rear view of silverware basket 200 with door 120 removed to show support 260 extending through opening 232 of back wall 230. Ramp 270 extends along slope S from high point 272 to low point 274 through opening 232. Thus, as described above, when silverware basket 200 is urged in the vertical direction V (FIG. 4) by a user, bottom 264 (FIG. 4) of flange 262 is directed by ramp 270 along slope S out of opening 232.

FIGS. 3-6 illustrate silverware basket 200 according to an exemplary embodiment of the present subject matter. It should be understood that the present subject matter is not limited to any particular style of silverware basket and that the embodiment depicted in FIGS. 3-6 is for illustrative purposes only. Other configurations may be used as well, e.g., silverware baskets having different handles, hole or opening shapes, or number of cavities.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a cabinet having a wash chamber for receipt of articles for cleaning;

a door rotatably mounted to said cabinet, said door configured for permitting selective access to the wash chamber of said cabinet;

a support mounted to said door, said support having a flange disposed adjacent a distal end of said support;

a rack assembly slidably mounted within the wash chamber and configured for receipt of articles for cleaning;

a silverware basket removably mounted to said door with said support, said silverware basket extending between a first side and a second side along a horizontal direction, said silverware basket further extending between a top and a bottom along a vertical direction, said silverware basket also extending between a front and a back along a transverse direction, the transverse direction being perpendicular to the horizontal and vertical directions, wherein said silverware basket comprises:

a bottom wall;

a front wall extending from said bottom wall along the vertical direction;

a back wall extending from said bottom wall along the vertical direction and spaced apart from said front wall along the transverse direction, wherein said bottom wall, said back wall, and said front wall define a cavity for receipt of articles for cleaning, said back wall defining an opening for receipt of said support, a portion of said back wall being disposed between said door and the flange of said support in order to mount said silverware basket to said, said back wall having an interior surface and an exterior surface; and a ramp fixed to said back wall adjacent the opening, said ramp having a low point and a high point spaced apart from the low point along the transverse direction with the high point disposed above the low point along the vertical direction, said ramp configured for urging said silverware basket away from said door during removal of said silverware basket from said door; the low point of said ramp fixed to the exterior surface of said back wall, the high point of said ramp fixed to the interior surface of said back wall; and a spray arm assembly for applying a fluid to the articles in said rack assembly and said silverware basket.

2. The appliance of claim 1, wherein the flange of said support is substantially circular.

3. The appliance of claim 1, wherein the low point of said ramp is spaced apart from the exterior surface of said back wall along the transverse direction, the high point of said ramp being spaced apart from the interior surface of said back wall along the transverse direction.

4. The appliance of claim 1, further comprising a side rail disposed within the cavity, said side rail positioned adjacent the opening in order to prevent said support from engaging said back wall during dismounting of said silverware basket from said door.

5. The appliance of claim 4, further comprising an additional side rail disposed within the cavity, wherein said side rail is positioned adjacent a first end of the opening, said additional side rail being positioned adjacent a second end of the opening in order to hinder the support from engaging said back wall during dismounting of said silverware basket from said door.

6. The appliance of claim 1, further comprising a divider extending between said front wall and said back wall in order to divide the cavity into a first cavity and a second cavity, wherein said divider includes said ramp.

7. The appliance of claim 1, wherein said bottom wall, said back wall, and said front wall define a plurality of holes for directing wash fluid out of the cavity.

8. The appliance of claim 1, wherein the silverware basket is constructed of plastic.

9. A silverware basket for a dishwasher appliance, the silverware basket extending between a first side and a second side along a horizontal direction, the silverware basket further extending between a top and a bottom along a vertical direction, the silverware basket also extending between a front and a back along a transverse direction, the transverse direction being perpendicular to the horizontal and vertical directions, the silverware basket comprising:

a bottom wall;

a front wall extending from said bottom wall along the vertical direction;

a back wall extending from said bottom wall along the vertical direction and spaced apart from said front wall along the transverse direction, wherein said bottom wall, said back wall, and said front wall define a cavity for receipt of articles for cleaning, wherein said back wall defines an opening configured for receipt of a support in order to mount the silverware basket to a door of the dishwasher appliance;

a ramp fixed to said back wall adjacent a bottom of the opening, said ramp having a low point and a high point spaced apart from the low point along transverse direction with the high point disposed above the low point along the vertical direction, said ramp configured for cooperating with the support during dismounting of the silverware basket from the door of the dishwasher appliance in order to urge the silverware basket away from the door; and a side rail disposed within the cavity substantially parallel to said ramp along the vertical direction, said side rail positioned adjacent the opening in order to prevent the support from engaging said back wall during dismounting of the silverware basket from the door of the dishwasher appliance.

10. The silverware basket of claim 9, wherein said back wall has an interior surface and an exterior surface, the low point of said ramp being spaced apart from the exterior surface of said back wall along the transverse direction, the high point of said ramp being spaced apart from the interior surface of said back wall along the transverse direction.

11. The silverware basket of claim 10, wherein said ramp has a slope between the high point and the low point of said ramp along the vertical and transverse directions, wherein a bottom end of the opening has about the same angle of the slope between the interior surface and the exterior surface of said back wall along the vertical and transverse directions.

12. The silverware basket of claim 9, wherein said side rail is positioned adjacent a first side of the opening, further comprising an additional side rail disposed within the cavity substantially parallel to said ramp along the vertical direction, said additional side rail positioned adjacent a second side of the opening in order to prevent the support from engaging said back wall at the second end of the opening during dismounting of the silverware basket from the door of the dishwasher appliance.

13. The silverware basket of claim 9, further comprising a divider extending between said front wall and said back wall in order to divide the cavity into a first cavity and a second cavity, wherein said divider includes said ramp.

14. The silverware basket of claim 9, wherein said bottom wall, said back wall, and said front wall define a plurality of holes for directing wash fluid out of the cavity.

15. The silverware basket of claim 9, wherein the silverware basket is constructed of plastic.

* * * * *